US005597537A

United States Patent [19]

Wegerer et al.

[11] Patent Number: 5,597,537

[45] Date of Patent: Jan. 28, 1997

[54] FCC FEED CONTACTING WITH CATALYST RECYCLE REACTOR

[75] Inventors: David A. Wegerer, Lisle; David A. Lomas, Barrington, both of Ill.

[73] Assignee: UOP, Des Plaines, Ill.

[21] Appl. No.: 467,245

[22] Filed: Jun. 6, 1995

Related U.S. Application Data

[60] Division of Ser. No. 216,378, Mar. 23, 1994, Pat. No. 5,451,313, which is a continuation-in-part of Ser. No. 125, 723, Sep. 24, 1993, Pat. No. 5,346,613.

[51] Int. Cl.[6] ..... F27B 15/00

[52] U.S. Cl. ..... 422/144; 422/145; 422/146; 422/147; 422/214; 422/215; 422/223; 422/224

[58] Field of Search ..... 422/144, 145, 422/146, 147, 214, 215, 223, 224

[56] References Cited

U.S. PATENT DOCUMENTS

| | | | |
|---|---|---|---|
| 2,451,619 | 10/1948 | Hengstebeck | 196/52 |
| 3,679,576 | 7/1972 | McDonald | 208/74 |
| 3,821,103 | 6/1974 | Owen et al. | 208/72 |
| 3,849,291 | 11/1974 | Owen | 208/78 |
| 3,888,762 | 6/1975 | Gerhold | 208/120 |
| 3,926,778 | 12/1975 | Owen et al. | 208/74 |
| 4,440,629 | 4/1984 | Stine | 208/111 |
| 4,717,467 | 1/1988 | Haddad et al. | 208/113 |
| 4,826,586 | 5/1989 | Herbst et al. | 208/70 |
| 4,853,105 | 8/1989 | Herbst et al. | 208/74 |
| 4,892,643 | 1/1990 | Herbst et al. | 208/70 |
| 4,960,503 | 10/1990 | Haun et al. | 208/85 |
| 4,961,907 | 10/1990 | Herbst et al. | 422/144 |
| 4,990,314 | 2/1991 | Herbst et al. | 422/144 |
| 5,017,343 | 5/1991 | Cetinkaya | 422/140 |
| 5,205,992 | 4/1993 | van Ommen et al. | 422/140 |
| 5,346,613 | 9/1994 | Lomas et al. | 208/164 |

*Primary Examiner*—Asok Pal
*Assistant Examiner*—Bekir L. Yildirim
*Attorney, Agent, or Firm*—Thomas K. McBride; John G. Tolomei

[57] ABSTRACT

An FCC process mixes spent and regenerated catalyst to obtain thermal equilibrium of a blended catalyst stream before contacting feed with the blended catalyst stream. The spent and regenerated catalyst from the reactor and regenerator catalyst may be mixed in a blending vessel located at the bottom of an FCC riser that can also serve as a hot catalyst stripper.

8 Claims, 3 Drawing Sheets

FCC FEED CONTACTING WITH CATALYST RECYCLE REACTOR

CROSS REFERENCE TO RELATED APPLICATIONS

This application is a Divisional application of prior application Ser. No. 08/216,378, filed Mar. 23, 1994, now U.S. Pat. No. 5,451,313, which is a continuation-in-part of U.S. Ser. No. 08/125,723, filed Sep. 24, 1993, now issued as the U.S. Pat. No. 5,346,613.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to feed and catalyst contacting.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to generally by those skilled in the art as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity. Two facets of the FCC process that have received attention are recovery of adsorbed products from the spent FCC catalyst and initial contacting of the FCC feed with the regenerated catalyst. Improvement in the recovery of hydrocarbons from spent catalyst directly improves yields while better initial feed and catalyst contacting tends to benefit yield and selectivity.

A variety of devices and piping arrangements have been employed to initially contact catalyst with feed. U.S. Pat. No. 5,017,343 is representative of devices that attempt to improve feed and catalyst contacting by maximizing feed dispersion. Another approach to improved feed and catalyst contacting is to increase the penetration of the feed into a flowing stream of catalyst. U.S. Pat. No. 4,960,503 exemplifies this approach where a plurality of nozzles ring an FCC riser to shoot feed into a moving catalyst stream from a multiplicity of discharge points. While these methods do improve distribution of the feed into the hot regenerated catalyst stream, there is still a transitory period of poor distribution when the relatively small quantities of the hydrocarbon feed disproportionately contact large quantities of hot catalyst. This poor thermal distribution results in non-selective cracking and the production of low value products such as dry gas.

A different approach to feed and catalyst contacting reduces local temperature maldistribution when mixing hot catalyst with the feed. U.S. Pat. No. 4,960,503 teaches indirect heating of the feed with the hot catalyst before contacting the feed with the regenerated catalyst in a reaction zone. By raising the temperature of the feed, less feed heating is required as the catalyst and feed are combined. Heating of the feed by indirect heat exchange with the catalyst can cause coking in the heat exchange equipment.

Therefore, improved methods are sought for disbursing feed within the catalyst stream while avoiding localized overheating of the feed and achieving thermal equilibrium between the relatively hotter catalyst and the relatively cooler feed. Such methods would reduce the localized overheating of the feed or the severity of the feed heating caused by the large temperature differentials between the feed and the catalyst which both contribute to feed overcracking.

Aside from improving initial feed and catalyst contacting, more complete stripping of hydrocarbons from the spent catalyst offers an additional means of recovering more useful products from the FCC unit. More complete stripping removes hydrocarbons from the catalyst that are lost by combustion when the spent catalyst enters the regeneration zone. Common methods to more completely strip catalyst raise the temperature of the spent catalyst in the stripping zone as a means of desorbing hydrocarbons from spent catalyst prior to regeneration. One system for heating spent catalyst in the stripping zone employs indirect heat transfer. A more common method of heating spent catalyst in the stripping zone mixes higher temperature regenerated catalyst with the spent catalyst in the stripping zone. U.S. Pat. Nos. 3,821,103 and 2,451,619 describe systems for direct heating of spent catalyst with hot regenerated catalyst.

While hot catalyst stripping of catalyst entering the regenerator will keep potential products out of the regenerator, stripping of the catalyst leaving the regenerator could displace inert gases from void volume of the catalyst to prevent carryover of inert material from the regenerator to the reactor. Stripping of regenerated catalyst has not been successfully practiced due to problems of catalyst deactivation. Contact of the high temperature regenerated catalyst with steam will thermally deactivate the catalyst and makes regenerated catalyst stripping impractical.

In addition to increasing hydrocarbon recovery, reducing the carryover of hydrocarbons into the regeneration zone improves the overall heat balance of the FCC unit. Hydrocarbons that enter the regeneration zone release additional high temperature heat as they burn in the oxygen atmosphere. Any additional heat release in the regenerator interferes with the regenerator operation by raising temperatures in the regeneration zone or requiting cooling methods to maintain a suitable temperature.

The processing of increasingly heavier feeds and the tendency of such feeds to elevate coke production makes the control of regenerator temperatures difficult. Optimization of feedstock conversion is ordinarily thought to require essentially complete removal of coke from the catalyst. This essentially-complete removal of coke from catalyst is often referred to as complete regeneration. Complete regeneration produces a catalyst having less than 0.1 and preferably less than 0.05 weight percent coke. In order to obtain complete regeneration, oxygen in excess of the stoichiometric amount necessary for the combustion of coke to carbon oxides is charged to the regenerator. Excess oxygen in the regeneration zone will also react with carbon monoxide produced by the combustion of coke, thereby yielding a further evolution of heat.

Apart from the objective of minimizing dilute phase CO combustion, the increase in coke on spent catalyst results in a larger amount of coke being burned in the regenerator per pound of catalyst circulated. Heat is removed from the regenerator in conventional FCC units in the flue gas, and principally in the hot regenerated catalyst stream. An increase in the level of coke on spent catalyst will increase the temperature difference between the reactor and the regenerator, and the regenerated catalyst temperature overall. A reduction in the amount of catalyst circulated is, therefore, necessary in order to maintain the same reactor temperature. However, as discussed above the lower catalyst circulation rate required by the higher temperature difference between the reactor and the regenerator will lower hydrocarbon conversion, making it necessary to operate with a higher reactor temperature in order to maintain conversion at the desired level. This will cause a change in yield structure which may or may not be desirable, depending on what products are required from the process. Also, there are limitations to the temperatures that can be tolerated by FCC catalyst without having a substantial detrimental effect on catalyst activity. Generally, with commonly available modern FCC catalyst, temperatures of regenerated catalyst are usually maintained below 760° C. (1400° F.), since loss of activity would be very severe at about 760°–790° C. (1400°–1450° F.). If a relatively common reduced crude such as that derived from Light Arabian crude oil was charged to a conventional FCC unit, and operated at a temperature required for high conversion to lighter products, i.e., similar to that for a gas oil charge, the regenerator temperature would operate in the range of 870°–980° C. (1600°–1800° F.).

Restricting the catalyst circulated through the reactor side of the FCC process affects more than yield structure of the products. The circulation rate of catalyst to the reactor influences the catalyst circulation rate through the regenerator. A decrease in the circulation of catalyst to the reactor can also lower the overall catalyst circulation rate through the regenerator. The use of additional conduits such as a recirculation line that transfers catalyst from the outlet of the regeneration zone to the inlet of the regeneration zone can reduce the interdependency of catalyst circulation through the reactor and regeneration zone. However, the use of a recirculation conduit complicates regulation of the catalyst circulation through the process and necessitates the maintenance of additional catalyst inventory on the reactor and regenerator side of the process to provide a buffer for variations in catalyst circulation. Thus, the reactor and regenerator usually operate with two interdependent catalyst circulation loops.

There are a number of patents that decouple the two interdependent loops by returning catalyst recovered from the reactor back to the reaction zone inlet. U.S. Pat. No. 3,679,576 represents one approach to such recirculation of catalyst where spent and regenerated pass together momentarily through a short section of relatively small diameter conduit before contacting the FCC feed. U.S. Pat. No. 3,888,762 shows a variation on such an arrangement where the feed, catalyst from the reactor and regenerated catalyst all come together simultaneously in a riser conduit. These arrangements offer greater flexibility in the circulation of catalyst through the FCC unit and the catalyst to feed ratio, but they do not address the problem of localized feed overcracking and feed heating severity.

It is an object of this invention to improve the initial mixing of catalyst with the hydrocarbon feed in an FCC process.

Another object of this invention is to decrease the thermal severity of the feed heating in an FCC process.

A further object of this invention is the stripping of inerts from regenerated catalyst without significant catalyst deactivation.

It is a further object of this invention to fully integrate the mixing of regenerated and catalyst from the reactor into a hot stripping operation for an FCC process.

It is yet another object of this invention to increase the circulation of catalyst through the reactor side of the process.

SUMMARY OF THE INVENTION

This invention uses circulation of catalyst that is generally referred to as "spent" and regenerated catalyst to reduce the severity and improve the dispersion of feed and catalyst contacting by combining spent and regenerated catalyst in a manner to approach or achieve thermal equilibrium between the spent and regenerated catalyst before contacting the combined catalyst stream with the feed. By not contacting feed with catalyst until a combined regenerated and reactor catalyst Stream have achieved substantial thermal equilibrium the actual temperature of catalyst particles correspond much more closely to a uniform average between the spent and regenerated catalyst temperatures. The lower temperature of the catalyst particles along with the increased volume of catalyst promotes more uniform heating of the feed and dispersion of the feed into the catalyst.

An essential part of this invention is the recycling of catalyst that has passed through the FCC reaction zone to moderate the temperature of the regenerated catalyst. In addition the recycled catalyst retains activity and therefore the term "spent catalyst" while generally accepted, is misdescriptive and it is the intention of this invention to more fully utilize this remaining activity the returning of what is herein termed recycle catalyst back to the reaction zone without regeneration.

Thermal equilibrium between the regenerated catalyst and the recycle catalyst may be approached in a variety of ways. Approaching thermal equilibrium requires sufficient time for heat transfer from the hot catalyst particles to the cool recycle catalyst particles. Thorough mixing or blending between the particles accelerates the heat transfer between the particles by increasing conductive heat transfer and overcoming the insulating effects of catalyst that inhibit heat transfer. Given sufficient time or length, thermal equilibrium may be approached while transferring catalyst through a simple conduit. However, since the catalyst flow in high flux standpipes tends to be plug flow with limited bubble induced turbulence or back mixing the interparticle heat transfer or effective conductivity is relatively low. Thus, catalyst in the typical standpipe flow acts as a good insulator and it would require a very long length of standpipe to reach substantial thermal equilibrium. The addition of mixers in the conduit would decrease the required length. A better arrangement uses a mixing zone to mix recycled and regenerated catalyst in a dense phase under dense phase back mix conditions to achieve substantial thermal equilibrium of the catalyst before contacting it with the feed. Such mixing zones most often take the form of a mixing chamber within a mixing vessel or blending vessel with a superficial gas velocity through the catalyst in a range of from 0.5 to 5 ft/sec to insure vigorous mixing. The blending vessel supplies a blended catalyst mixture to a conversion zone that raises the solids to oil ratio on the reaction side of the process and regulates catalyst temperatures on the reaction and the regeneration sides of the process.

In addition to thermal equilibrium the blending vessel provides ancillary advantages. By the introduction of a stripping gas into the blending vessel, it operates as a hot stripper to remove additional hydrocarbons from the blended catalyst which would otherwise enter the regeneration zone and inert gases from the regenerated catalyst that enters the reaction zone from the regenerator vessel. Combining both regenerated and recycle catalyst in the blending vessel increases the solids to feed ratio in the reaction zone. A greater solids ratio improves catalyst and feed contacting. Since the recycle catalyst still has activity, the catalyst to oil ratio is increased. Moreover, the larger quantity of catalyst more evenly and quickly distributes the heat to the feed.

Another possible advantage of this invention when used in combination with hot catalyst stripping is a reduction in the circulation of non-catalytic coke. Although not binding the invention to a particular theory it is generally accepted that catalyst after passing once through the riser will contain substantial proportions of two forms of coke. One form is generally characterized as soft and another as catalytic or graphitic coke. Soft coke comprises light hydrocarbons trapped in the voids of the catalyst particles and heavy hydrocarbons having a high affinity for any catalyst surface that never vaporized at ordinary reaction conditions or rapidly developed into a condensed structures of few rings with relatively high hydrogen. Catalytic coke generally comprises highly condensed, multiple hydrocarbon ring structures that are hydrogen deficient and developed by both catalytic and thermal cracking at active catalyst sites. Exposure of spent catalyst to the relatively high temperature and high steam partial pressure environment in the hot catalyst stripper of the blending vessel displaces voidage coke from the catalyst and promotes conversion of soft coke to graphitic coke with the evolution of hydrogen and light gases. Continued recirculation of spent catalyst particles on the reactor side of the process continues to convert soft coke to graphitic coke with a removal of voidage coke after each pass of the catalyst through the riser. Further conversion of coke and recovery of light gases and hydrogen from the hot stripping zone eliminate the disadvantageous conversion of these material in the regeneration zone.

The presence of coke on the catalyst can also benefit the process by reducing undesirable catalytic cracking reactions. The undesirable bimolecular reactions occur at highly acidic sites on the catalyst that are present on the fully regenerated catalyst. These sites strongly attract the hydrocarbon and are rapidly deactivated by coke accumulation. As subsequent recirculation passes coke particles through multiple cycles of riser contact without regeneration, these non-selective sites remain covered with catalyst so that only the more selective cracking sites remain active on the catalyst. The circulation of more selective sites cam improve the yield of more desirable products.

The invention is also well suited for use in short contact time reaction systems. Under short contact time conditions the catalyst and feed are kept in contact for very short periods of time and then quickly separated such that the catalyst undergoes little activation. Therefore, this invention will facilitate the recirculation of large quantities of recycled catalyst to the reaction zone without regeneration. The more feed and contact times are reduced, less deactivation will occur on the catalyst particles. Thus, in a short contact time arrangement it may be desirable to recycle 10, 20 or more parts of catalyst from the reactor for each part of regenerated catalyst.

The invention is particularly advantageous for the treatment of high nitrogen containing feed stocks. Nitrogen compounds in the feed serve as basic components that when attracted to the acidic cracking sites and cause temporary deactivation of such sites. By returning catalyst particles from the riser reaction zone and contacting the nitrogen containing catalyst particles under hot stripping conditions nitrogen compounds are removed and the activity of such sites restored without a full regeneration. In addition the nitrogen compounds may be recovered from the hot stripping vent gas as ammonia or other nitrogen compounds, thereby avoiding the generation of nitrogen oxides that accompanies the combustive removal of nitrogen compounds from the catalyst in the regeneration zone.

Accordingly this invention is in one embodiment a process for the fluidized catalytic cracking of a hydrocarbon containing stream. The process comprises contacting a feedstream containing hydrocarbons with a blended catalyst mixture in a conversion zone, to crack hydrocarbons in the feedstream and deposit coke on the catalyst in the mixture. The blended catalyst mixture comprises recycle and regenerated catalyst. A cracked hydrocarbon stream comprising cracked hydrocarbons is separated from the blended catalyst mixture and a first portion of the blended catalyst mixture is passed to a regeneration zone. The regeneration zone combusts coke from the particles to remove coke and produce regenerated catalyst particles having a temperature greater than the temperature of the blended catalyst. Recycle catalyst comprising a second portion of the blended catalyst mixture having a lower temperature than the blended temperature is recovered. At least a portion of the recycle catalyst and the regenerated catalyst is combined to establish thermal equilibrium between the recycle and regenerated catalyst to produce the blended catalyst mixture.

In another embodiment, this invention is a process for the fluidized catalytic cracking of an FCC feedstock, that comprises: passing the FCC feedstock into contact with a blended catalyst mixture in a riser conversion zone to crack hydrocarbons and deposit coke on catalyst particles; discharging cracked hydrocarbons and spent catalyst from the riser conversion zone and separating spent catalyst from the cracked hydrocarbons; passing a portion of the spent catalyst to a regeneration zone and combusting coke from the spent catalyst to produce regenerated catalyst particles; combining regenerated catalyst and recycle catalyst comprising a portion of said spent catalyst in a mixing zone located at the bottom of the riser to produce the blended catalyst mixture; passing a fluidizing gas into the mixing zone and maintaining dense phase conditions in the mixing zone; passing the blended catalyst mixture into a transfer conduit having an inlet located in a lower portion of the mixing zone; and passing the blended catalyst from the transfer conduit into the riser conversion zone.

In an apparatus embodiment of this invention, the invention comprises an apparatus for the fluidized catalytic cracking of hydrocarbons. The invention includes a regenerator and a mixing vessel. The mixing vessel comprises a mixing chamber having a first diameter. A riser conduit defines an inlet in communication with the mixing chamber. The riser conduit has a second diameter that is smaller than the first diameter and an outlet at its opposite end. Means are provided for injecting a feedstream into the riser conduit at a location between the inlet and the outlet. A separator, in communication with an outlet defined by the riser, separates spent catalyst from gases. Means are provided for passing spent catalyst particles to the regenerator to regenerate the catalyst particles, passing regenerated catalyst particles from the regenerator to the mixing vessel, and passing recycle catalyst particles to the mixing vessel.

Additional objects, embodiments, and details of this invention will become apparent from the following detailed description.

DETAILED DESCRIPTION OF THE INVENTION

Figure 1:
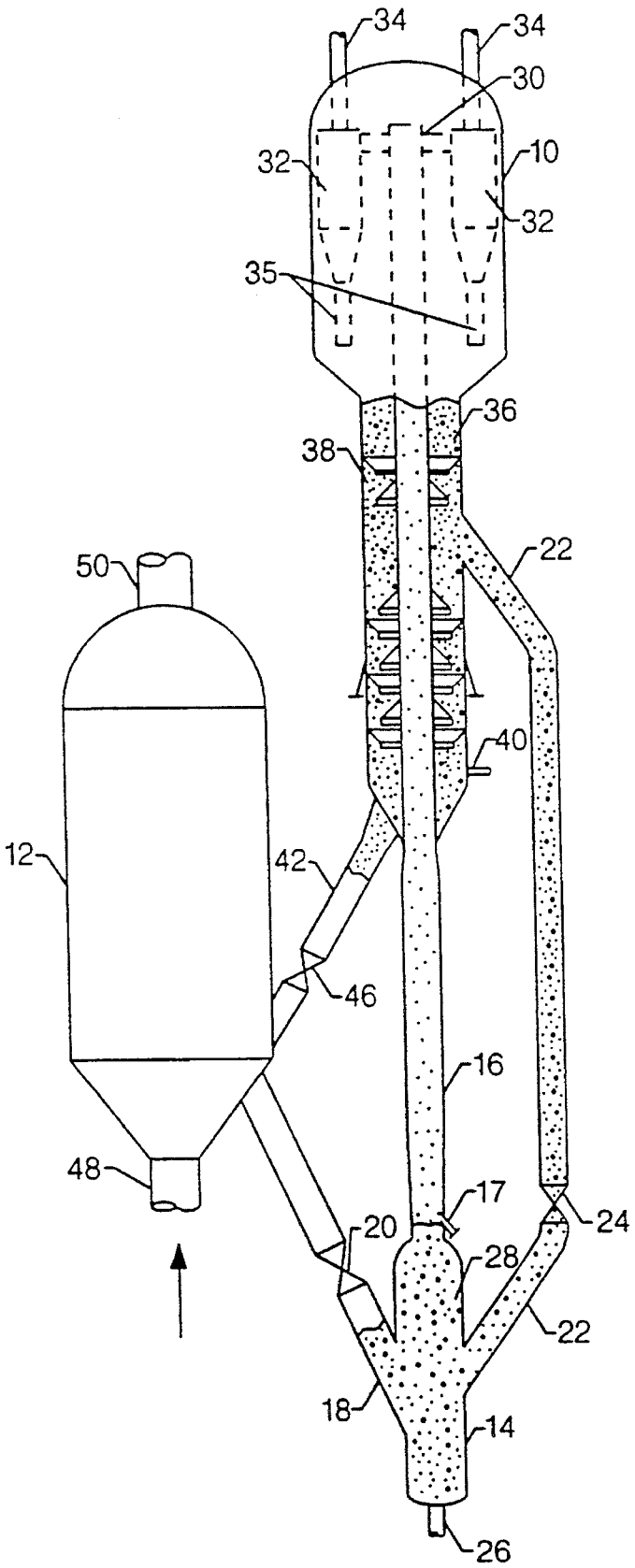
FIG. 1 is an elevation view showing an FCC regenerator and a schematic cross section of an FCC reactor in accordance with this invention.

This invention is more fully explained in the context of an FCC process. FIG. 1 shows a typical schematic arrangement of an FCC unit arranged in accordance with this invention. The description of this invention in the context of the specific process arrangement shown is not meant to limit it to the details disclosed therein. The FCC arrangement shown in FIG. 1 consists of a reactor 10, a regenerator 12, a blending vessel 14, and an elongate riser reaction zone 16 that provides a conversion zone for the pneumatic conveyance of catalyst. The arrangement circulates catalyst and contacts feed in the manner hereinafter described.

The catalyst that enters the riser can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as, silica, alumina, or zirconium. These catalyst compositions may have a zeolite content of 30% or more. ZSM-5 type catalysts are particularly preferred since the high coke selectivity of these catalyst will tend to preserve active sites as coke containing catalyst makes multiple passes through the riser and thereby maintain overall activity.

In addition to catalyst this invention may benefit from the circulation of inert particulate material. Recirculating solids on the reaction side of the process without regeneration will raise the level of coke on solids and can result in excessive regenerator temperature. Adding an inert material will decrease the average coke on solids ratio for material entering the regenerator without affecting the solids to oil ratio on the reactor side of the process. In this manner the inert material acts as a heat sink in the regeneration process. Suitable inert solids are any refractory material with low coke production properties such as alpha alumina, fused alumina and low surface area clays. Material and methods for recycling inert solids in an FCC processes are further described in U.S. Pat. No. 4,859,313, the contents of which are hereby incorporated by reference.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Aside from blending catalyst, an added benefit of this invention is the use of the blending vessel as a metals passivation zone. The blending vessel holds catalyst for a relatively long residence time. The blending vessel can also isolate passivation gas streams from the reactor and regenerator sides of the process. Therefore, the blending vessel can simultaneously serve as a passivation zone.

Looking then at the blending vessel of FIG. 1, a regenerator conduit 18 passes regenerated catalyst from regenerator 12 into blending vessel 14 at a rate regulated by control valve 20. A recycle conduit 22 passes catalyst from reactor 10 at a rate regulated by a control valve 24 into blending vessel 14. Fluidizing gas passed into blending vessel 14 by a conduit 26 contacts the catalyst and maintains the catalyst in a fluidized state to mix the recycle and regenerated catalyst. The blending vessel will normally have size about equivalent to that of the stripping vessel. Conduit 18 and conduit 22 may be arranged so that its end has a tangential orientation to the blending vessel. This tangential orientation will give catalyst entering the blending vessel a circumferential component of velocity to further promote mixing.

Blending the recycle and regenerated catalyst in the manner of this invention typically increases the relative amount of catalyst that contacts the feed. The amount of blended catalyst that contacts the feed will vary depending on the temperature of the regenerated catalyst and the ratio of recycle to regenerated catalyst comprising the catalyst blend. Generally, the ratio of blended catalyst to feed will be in ratio of from 5 to 50. The term "blended catalyst" refers to the total amount of solids that contact the feed and include both the regenerated catalyst from the regenerator and the recycle catalyst from the reactor side of the process. Preferably, the blended catalyst to feed will be in a ratio of from 10 to 20 and more preferably in ratio of from 10 to 15.

This higher ratio of catalyst to feed promotes rapid vaporization of the feed and increases the catalyst surface area in contact with the feed to make vaporization more uniform. The greater quantity of catalyst reduces the added heat per pound of catalyst for raising the temperature of the entering feed so that a high feed temperature is achieved with less temperature differential between the feed and the catalyst. Reduction of the temperature differential between the catalyst and feed prevents localized overheating of the feed and replaces violent mixing with the less severe contacting offered by the elevated volume of catalyst.

The regenerated catalyst will have a substantially higher temperature than the recycle catalyst. Regenerated catalyst from the regenerated conduit 18 will usually have a temperature in a range from 1100° to 1400° F. and, more typically, in a range of from 1200° to 1400° F. Once the blended catalyst mixture contacts the feed, as subsequently described, the blended catalyst mixture accumulates additional coke on the catalyst particles and has a lower temperature than the blended mixture upon its return to the blending vessel 14 as recycle catalyst. The temperature of the spent catalyst will usually be in a range of from 900° to 1150° F. The relative proportions of the recycle and regenerated catalyst will determine the temperature of the blended catalyst mixture that enters the riser. The blended catalyst mixture will usually range from about 1000° to 1400° F. and, more preferably is in a range of from 1050° to 1250° F. Supplying the heat of reaction for the cracking of the hydrocarbon feed requires a substantial amount of regenerated catalyst to enter the blending vessel. Therefore, the blended temperature of the blended catalyst mixture will usually be substantially above the recycle catalyst temperature. Ordinarily the ratio of recycle catalyst to regenerated catalyst entering the blending zone will be in a broad range of from 0.1 to 5 and more typically in a range of from 0.5 to 1.0.

A primary purpose of the blending vessel is mixing of the catalyst for sufficient time to achieve substantially thermal equilibrium. The recycle and regenerated catalyst spends sufficient time in the blending vessel to achieve substantially thermal equilibrium. In a dense phase back mix type zone, residence time of individual particles will vary. However, on average, catalyst particles will have a residence time of at least 2 seconds in the blending vessel. Preferably, the average residence time of the catalyst particles in the blending vessel is in a range of from 20 to 60 seconds. Maintaining dense phase conditions in the blending vessel greatly increases heat transfer between the catalyst particles. The dense phase conditions are characterized by a dense catalyst bed which is defined as having a density of at least 10 lbs/ft$^3$ and, more typically, a density of from 20 to 50 lbs/ft$^3$. In order to maintain turbulent conditions within the blending vessel, one or more streams of a fluidizing medium enter the vessel. The fluidizing gas may be diluent streams of inert material that enters the bottom of the blending vessel. In the arrangement shown by FIG. 1, all of the fluidization material will pass with the catalyst into the inlet 28 of riser 16. Therefore, inert materials are preferred for fluidization purposes. Fluidization gas passes through the blending zone at a typical superficial velocity of from 0.2 to 3 ft/sec. The preferred turbulent mixing within the dense catalyst bed fully blends the regenerated and recycle catalyst. In this manner, blending vessel 14 supplies a blended catalyst mixture to the bottom of riser 16.

The amount of coke on the recycle catalyst returning to the blending vessel will vary depending on the total residence time of specific catalyst particles within the process loop that passes from the blending vessel to the reactor and back to the blending vessel. Since the separation of catalyst particles out of the riser is random, some catalyst particles may have a long residence time within the reactor vessel before entering the regeneration zone. Nevertheless, the spent catalyst entering the regeneration zone as well as the recycle catalyst will typically have an average coke concentration of between 0.7 to 1.25 wt %.

Riser 16 provides a conversion zone for cracking of the feed hydrocarbons. Riser 16 is one type of conversion zone that can be used in conjunction with the blending zone of this invention. In a riser type arrangement for the conversion zone, the riser conduit has a smaller diameter than the blending vessel so that catalyst accelerates as it passes out of the blending vessel into the riser conduit. Dense phase conditions may be maintained in the lower portion of the riser conduit below the entry point of the feed. The riser above the point of feed injection typically operates with dilute phase conditions wherein the density is usually less than 20 lbs/ft$^3$ and, more typically, less than 10 lbs/ft$^3$. Feed is introduced into the riser somewhere between inlet 28 and substantially upstream from an outlet 30. Volumetric expansion resulting from the rapid vaporization of the feed as it enters the riser further decreases the density catalyst within the riser to typically less than 10 lbs/ft$^3$. The feed enters by nozzle 17, usually in a lower portion of the riser conduit 16. Before contacting the catalyst, the feed will ordinarily have a temperature in a range of from 300° to 600° F. Additional amounts of feed may be added downstream of the initial feed point.

The blended catalyst mixture and reacted feed vapors are then discharged from the end of riser 16 through an outlet 30 and separated into a product vapor stream and a collection of catalyst particles covered with substantial quantities of coke and generally referred to as spent catalyst. A separator, depicted by FIG. 1 as cyclones 32, removes catalyst particles from the product vapor stream to reduce particle concentrations to very low levels. Cyclone separators are not a necessary part of this invention. This invention can use any arrangement of separators to remove spent catalyst from the product stream. In particular a swift arm arrangement, provided at the end of riser 16 can further enhance initial catalyst and cracked hydrocarbon separation by imparting a tangential velocity to the exiting catalyst and converted feed mixture. Such swift arm arrangements are more fully described in U.S. Pat. No. 4,397,738 the contents of which are hereby incorporated by reference. Product vapors comprising cracked hydrocarbons and some catalyst exit the top of reactor vessel 10 through conduits 34. Catalyst separated by cyclones 32 return to the reactor vessel through dip leg conduits 35 into a dense bed 36.

Product vapors are transferred to a separation zone for the removal of light gases and heavy hydrocarbons from the products. Product vapors enter a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

Catalyst drops from dense bed 36 through a stripping section 38 that removes adsorbed hydrocarbons from the surface of the catalyst by countercurrent contact with steam. Steam enters the stripping zone 38 through a line 40. Spent catalyst stripped of hydrocarbon vapors leave the bottom of stripper section 38 through a spent catalyst conduit 42 at a rate regulated by a control valve 46.

Recycle catalyst for transfer to the blending vessel may be withdrawn from the reaction zone or reactor vessel or even reactor riser after the blended catalyst mixture has undergone a sufficient reduction in temperature. Recycle catalyst is most typically withdrawn downstream of the reactor riser and, more typically, from the stripping zone. FIG. 1 depicts the withdrawal of recycle catalyst from an upper portion of the stripping zone 38. The recycle catalyst conduit transfers one portion of the spent catalyst exiting riser 16 back to the blending vessel as recycle catalyst. Another portion of the spent catalyst is transported to the regeneration zone for the removal of coke.

On the regeneration side of the process, spent catalyst transferred to the regeneration vessel 12 via conduit 42 at a rate regulated by a control valve 46 undergoes the typical combustion of coke from the surface of the catalyst particles by contact with an oxygen containing gas. The oxygen containing gas enters the bottom of the regenerator via an inlet 48 and passes through a dense fluidizing bed of catalyst (not shown). Flue gas consisting primarily of CO or $CO_2$ passes upward from the dense bed into a dilute phase of regeneration vessel 12. A separator, such as the cyclones previously described for the reactor vessel or other means, remove entrained catalyst particles from the rising flue gas before the flue gas exits the vessel through an outlet 50. Combustion of coke from the catalyst particles raises the temperatures of the catalyst to those previously described for catalyst withdrawn by regenerator standpipe 18.

Figure 2:
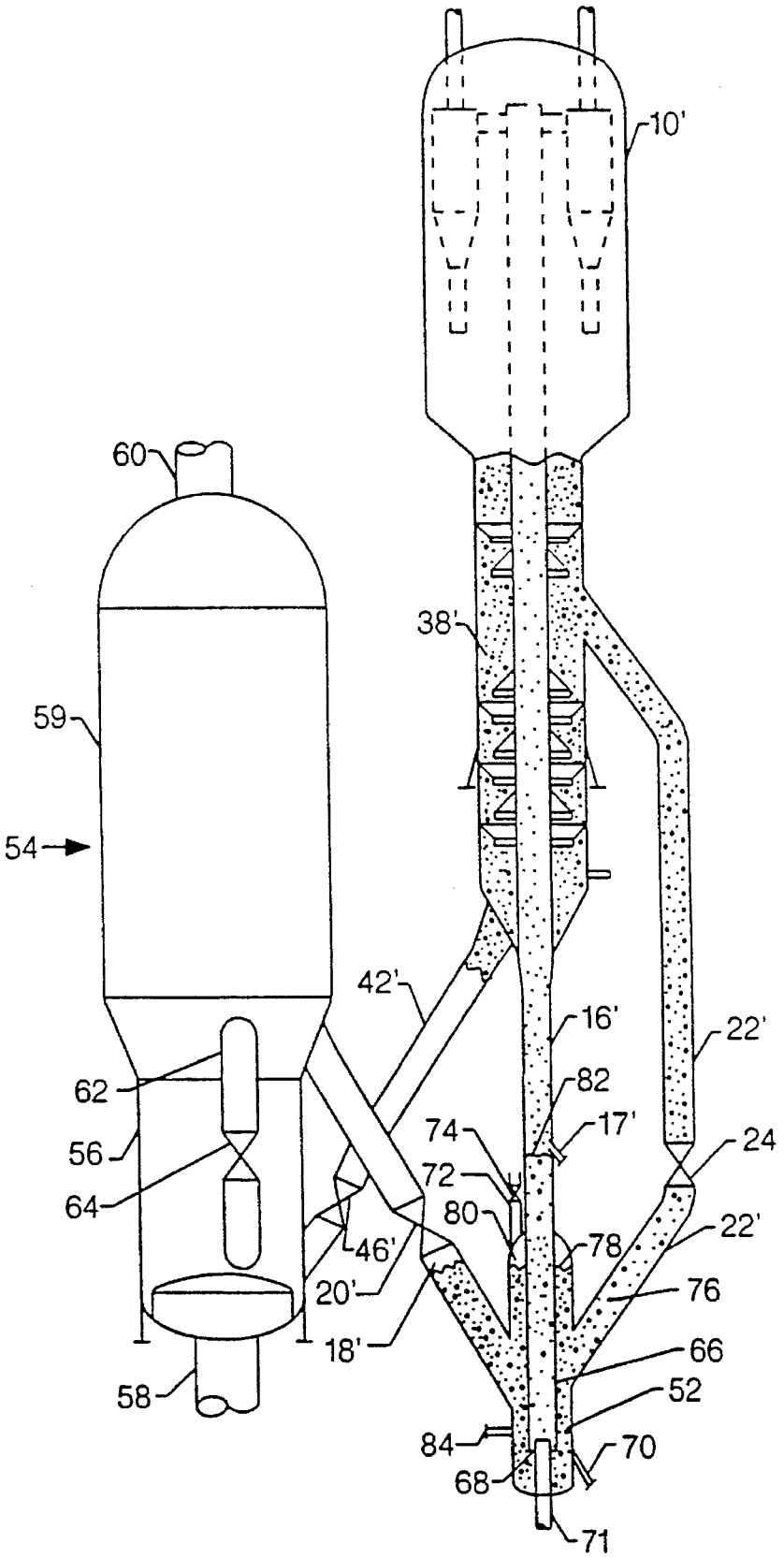
FIG. 2 is an elevation view showing a modified regenerator and a modified cross section of the FCC reactor relative to FIG. 1.

FIG. 2 shows another arrangement for an FCC unit arranged in accordance with the process and apparatus of this invention. This arrangement shows a modified blending vessel 52 at the lower part of a riser 16' which passes a mixture of blended catalyst and cracked hydrocarbons to a reactor vessel 10' which is arranged with a recycle conduit 22' and stripping section 38' that all operate in essentially the same manner as that previously described in conjunction with FIG. 1. FIG. 2 also shows the blending vessel used in conjunction with a combustor style regenerator 54.

Regenerator 54 receives spent catalyst from a spent catalyst conduit 42' in a lower combustor 56 at a rate regulated by control valve 46'. Air entering combustor 56 via a line 58 maintains a fast fluidized zone in the combustor. The fast fluidized conditions establish an upward catalyst transfer velocity of between 8 to 25 ft/sec in a density range of from 4 to 34 lbs/ft$^3$. Combustion of coke from catalyst particles continues through an internal riser (not shown) that transfers catalyst to an upper disengaging zone 59. Residence time through the combustor and riser will usually provide sufficient reaction time to completely combust coke and fully regenerate the catalyst i.e. removal of coke to less than 0.1 wt %. In addition, the combustor style regenerator usually effects a complete combustion CO to $CO_2$. Cyclones or other separators in disengaging zone 59 remove entrained hydrocarbons from flue gases that exit the regenerator 54 through an outlet nozzle 60. A portion of the catalyst contained in the disengaging vessel 58 may be recirculated back to the combustor through a line 62 at a rate regulated by a control valve 64. The remainder of the regenerated catalyst is returned to the blending vessel via line 18'.

Regenerated catalyst from line 18' at a rate regulated by a control valve 20' and recycle catalyst from line 22', at a rate regulated by control valve 24,' enter blending vessel 52. Blending vessel 52 contains a transfer conduit 66 having an inlet 68. Fluidization gas enters blending vessel 52 from a conduit 70. Fluidization gas 70 again promotes back mix conditions and turbulence within the blending vessel to increase the mixing of catalyst and heat transfer between the recycle and regenerated catalyst. Blending vessel 52 also has a vent line 72 that vents gas from the top of the blending vessel 52 at a rate regulated by a control valve 74. Gas vented from line 72 may consist of any gaseous material that enters the blending vessel from an inlet conduit or with the regenerated or recycle catalyst. The amount of fluidizing gas entering blending vessel 52 is again in an amount that will produce a superficial gas velocity in a range of from 1 to 3 ft/sec. However, transport conduit 56 occludes the top of blending vessel 52 and establishes an annular bed 76 of dense phase catalyst. By regulating the venting of gas from the blending vessel through conduit 72, a bed level 78 is maintained above inlet 68. Bed level 78 provides an interface between a dilute phase 80 and the dense phase bed 76. The dilute phase 80 allows the collection of gas from dense bed 52 so that fluidizing gas or other vaporous materials may pass through dense bed 76 without exiting through riser 16'.

Depending upon the mount of venting through line 74, transport conduit 66 may pass catalyst in either dense or dilute phase up to feed contact nozzle 17'. Where the amount of fluidizing gas vented through line 74 does not equal the fluidizing gas addition, fluidizing gas also passes up through transport conduit 66. Thus, the fluidizing gas can also serve as a lift fluid to carry catalyst up the riser. Additional gases such as fluidizing gas, diluent or reactants may be injected directly into inlet 68 by conduit 71.

In the arrangement depicted by FIG. 2, the amount of fluidizing gas entering transport conduit 66 is limited to maintain dense phase conditions in the conduit. Dense phase conditions in transport conduit 66 establishes a bed level 82 at approximately the level of feed injection by nozzle 17', above which vaporization of feed creates additional gases for more dilute phase transport of catalyst up the remainder of the riser. In this manner the combination of vent line 72 and inlet 68 provides means for regulating the transfer of blended catalyst into riser 16'. When the dilute phase pressure exceeds the pressure differential attributable to the difference in height between bed level 78 and bed level 82, the pressure in dilute phase 80 forces dense phase catalyst up through transport conduit 66 to the feed injection point provided by nozzle 17'. Again, pressure in dilute phase 80 is controlled by regulating the addition of fluidizing gas into blending vessel 52 and the discharge of gas from vent 72. In a preferred method of controlling the blending vessel, the position of valve 74 may be automatically controlled in response to a level measurement of bed level 78 at a constant fluidizing gas addition rate. In this manner, the overall addition of catalyst to riser 16' is controlled by adjusting the pressure in dilute phase 80 and the proportion of recycle to regenerated catalyst entering blending vessel 52 is controlled by control valve 24'. In such a system, the amount of blended catalyst entering riser 16' is set by the pressure level in dilute phase 80 while the proportion of spent to regenerated catalyst entering the lift conduit at a given catalyst addition rate is increased or decreased by opening or closing control valve 24'.

Blending vessel 52 can provide a number of functions in addition to catalyst blending. For example, the blending zone can be used as an added stage of stripping and provides a particularly beneficial use of the blending zone. The blending of regenerated catalyst typically elevates the temperature of the blended catalyst so that a stripper-blending zone provides hot stripping. Aside from product recovery, the blending zone can strip entrained inert gases, that accompany the catalyst from the regeneration step, from the catalyst.

Blending vessel 52 may also be arranged such that there is a substantial degree of separation between gases entering the annular bed 76 and the composition of gases entering transport conduit 66. For example, other process streams or diluents may be added above inlet 68. The addition of stripping steam through conduit 70 below inlet 68 will displace the process streams added through nozzle 84 and keep the gases entering through nozzle 84 from entering transport conduit 66 and riser 16' in any substantial quantities. Thus, the blending zone may also provide a number of other process functions. Thus, in a further use of the blending zone, line 84 may also charge a secondary feed to the blending vessel which may operate as a secondary reactor. It is even possible to use blending vessel 14 as an additional stage of regeneration by passing an oxygen-containing gas to the regeneration zone. Thus, the fluidizing gas entering through line 70 or 84 may comprise air, steam, additional feedstreams, etc.

Vent line 72 can pass gas out of the top of mixing vessel 14 to a variety of locations. Depending on its composition, the fluidizing gas may be passed back into the reactor for recovery of additional product vapors, processed separately to recover a secondary product stream or returned to the regeneration zone and combined with the flue gas stream exiting the regenerator.

The reactor and regenerator arrangement shown in FIGS. 1 and 2 may also benefit from external heat removal. Such external heat recovery systems include well known arrangements such as catalyst coolers and remove heat by indirect heat exchange. Where a catalyst cooler is employed it will typically receive catalyst from and return catalyst to the regenerator side of the process where temperatures are the highest. The higher temperatures associated with the regenerator side of the process ordinarily improve the efficiency of the heat removal apparatus. However, catalyst entering the blending vessel may also circulate through a heat exchanger for heat recovery. Accordingly catalyst for cooling may exit either the regeneration zone or the blending zone and return either to the regeneration zone or the blending zone.

EXAMPLE 1

This invention may be practiced with different operating conditions and arrangement to accommodate different modes of operation. In the production of light olefins the process will typically operate with a relatively high reactor temperature and a high recirculation of recycle catalyst to regenerated catalyst. More specifically in one operation the temperature of the catalyst and vapor mixture as it exits the riser will range from 990° F. to 1000° F. The regeneration temperature will operate at a high temperature usually ranging above 1350°, but typically limited to 1400° F. The hot catalyst from the regenerator is mixed with recycle catalyst in a ratio of 1:2 to provide a total catalyst to feed ratio of about 12/1. Blending of the catalyst streams will equilibrate the temperature of the catalyst entering the riser at about 1130° F. The high ratio of catalyst to oil and high regenerator temperature causes cracking reaction to predominate so that gasoline fraction will over-crack to provide a high yield of $C_3$ and $C_4$ olefins.

This olefin production operation with the return of recycle catalyst produces $C_3$ and $C_4$ olefins with a reduced production of dry gas and coke relative to conventional operation to produce olefins. In a conventional olefin production operation regenerated catalyst temperature would average about 1320° F. and would be mixed with the feed in a catalyst to oil ratio of about 8:1. Contact between the feed and the catalyst through the riser reactor reduces the temperature of the feed and catalyst mixture to about 1020° F. After stripping all of the catalyst from the reaction zone enters the regeneration zone. An operation of this type would increase dry gas and coke production by about 15% and 10% respectively.

EXAMPLE 2

Figure 3:
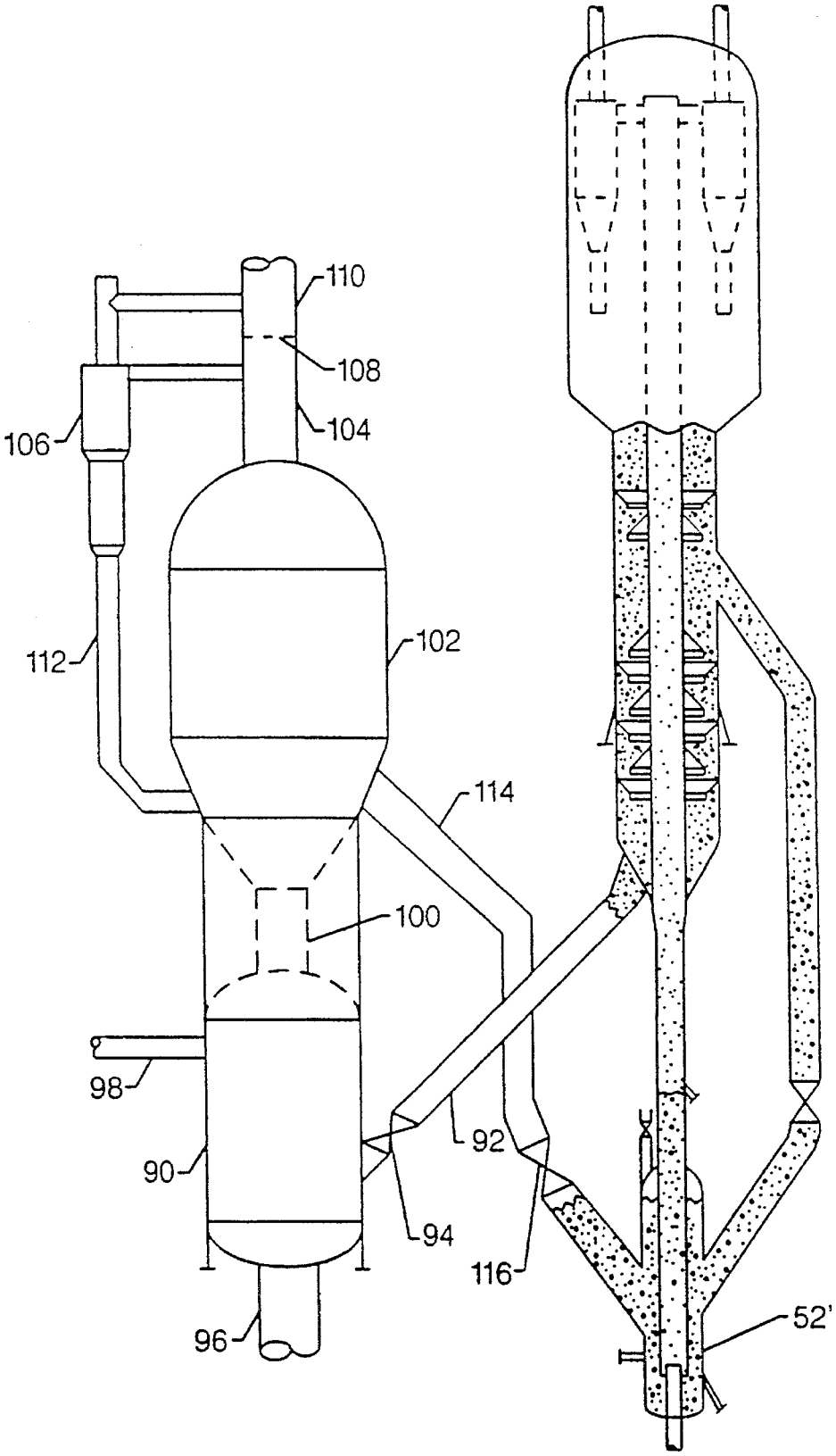
FIG. 3 is an elevation view showing the modified cross section of the reactor of FIG. 1 with a modified regenerator arrangement.

FIG. 3 shows an FCC arrangement for the processing of residual feed streams that is arranged in accordance with this invention. Other than variation in processing conditions and catalyst circulation rates the reaction side of the process operates in the same manner as that previously described. High regenerated catalyst temperatures, produced by a complete combustion of coke and CO in the regenerator, characterize this type of operation.

Regenerated catalyst enters a first stage of combustion in regenerator vessel 90 from a spent standpipe 92 at a rate regulated by a control valve 94. Contact of the coke containing catalyst particles with air from conduit 96 initiates a first stage of combustion at relatively low combustion that does not exceed 1300° F. The low temperature combustor performs primary reaction that combusts soft coke and the high hydrogen containing consumables that enter vessel 90. Catalyst and gas separation (not shown) in vessel 90 removes the gases having a high moisture content from the regeneration vessel via a line 98. Removal of high moisture content gases eliminates the production of an environment that would hydrothermally deactivate the catalyst in the second stage of regeneration which the catalyst enters next.

Catalyst containing a majority of the catalytic coke passes via an internal conduit 100 to a second stage of regeneration contained in a regeneration vessel 102. Regeneration in the presence of sufficient air to fully convert CO to $CO_2$ fully regenerates the catalyst and produces catalyst with catalyst temperatures of at least 1400° F. and potentially up to 1700° F. To-accommodate these high temperature vessel 102 contains no internal equipment and an external cyclone 106 separates catalyst from combustion gases as both exit the vessel through a conduit 104. Gases now substantially free of catalyst particles exit the regeneration system via a conduit 110. A baffle 108 separates conduit 104 from conduit 110. The recovered catalyst passes back from cyclone 106 back to vessel 102 for transport to blending vessel 52' through a conduit 114 at a rate regulated by a control valve 116.

In a prior art operation of this two stage regeneration process the temperature of the second stage is limited to about 1400° F. to maintain a sufficient rate of catalyst circulation without excessive reactor temperatures. A catalyst temperature of 1400° F. and a catalyst to feed ratio of 5:1 produces a riser temperature of 990° F. at its outlet.

The operation of this invention permits the regenerator to operate a temperature of 1700° F. Passing the 1700° F. regenerated catalyst to the blending vessel at a regenerated catalyst to feed ratio of 3:1 and combining recycle catalyst at a temperature 990° F. to produce a total solids to feed ratio 9:1 will provide a blended catalyst temperature of about 1227° F. for initial contact with the feed. Temperature conditions at the end of riser will again be about 990° F. The increased amount of solids and the reduced temperature differential between the catalyst and the feed will reduce the production of dry gas by about 20% and increase conversion by about 5% relative to the prior art operation. Thus the arrangement of this invention permits ultra high regenerator temperatures in an operation to crack residual hydrocarbons without increasing dry gas production or losing conversion.

What is claimed is:

1. An apparatus for the fluidized catalytic cracking of hydrocarbons, said apparatus comprising:

a) a mixing vessel comprising a mixing chamber having a first diameter;

b) a riser conduit defining an inlet in communication with said mixing chamber at one end and an outlet at its opposite end, said riser conduit having a second diameter that is smaller than said first diameter;

c) means for injecting a feedstream into said riser conduit at a location between said inlet and said outlet;

d) a separator in communication with said outlet for separating spent catalyst from gases;

e) a regenerator;

f) means for passing spent catalyst particles to said regenerator to regenerate catalyst particles;

g) means for passing regenerated catalyst particles from said regenerator to said mixing vessel; and, h) means for passing recycle catalyst comprising a portion of said spent catalyst particles to said mixing vessel.

2. The apparatus of claim 1 wherein said mixing vessel includes means for admitting a fluidizing gas into said vessel.

3. The apparatus of claim 2 further comprising means for regulating the flow of a fluidizing gas out of said mixing vessel.

4. The apparatus of claim 1 wherein a lower portion of said riser conduit extends into said mixing vessel and said inlet has a location in a lower portion of said mixing vessel.

5. The apparatus of claim 4 wherein said means for injecting a feedstream is arranged to inject a feedstream into a portion of said riser conduit located outside of said mixing vessel.

6. An apparatus for the fluidized catalytic cracking of hydrocarbons, said apparatus comprising:

a) a mixing vessel comprising a mixing chamber;

b) a vertically extended riser conduit defining an inlet located in a lower portion of said mixing chamber and an outlet at the opposite end of said riser conduit;

c) means for injecting a feedstream into said riser conduit at a location outside of said mixing vessel;

d) means for separating catalyst and gases discharged from said outlet;

e) a stripping vessel for receiving catalyst in communication with said means for separating catalyst;

f) a regenerator;

g) a reactor conduit for communicating catalyst from said stripping vessel to said regenerator;

h) a regenerator conduit for communicating catalyst particles from said regenerator to said mixing vessel; and, i) a recycle catalyst conduit for communicating catalyst from said stripping vessel directly to said mixing vessel.

7. The apparatus of claim 6 wherein said mixing vessel includes means for admitting a fluidizing gas into said vessel.

8. The apparatus of claim 7 further comprising means for regulating the flow of a fluidizing gas out of said mixing vessel.

* * * * *